US010319278B1

(12) United States Patent
Nho et al.

(10) Patent No.: US 10,319,278 B1
(45) Date of Patent: Jun. 11, 2019

(54) NONLINEAR PULSE-WIDTH-MODULATED CLOCK GENERATION

(71) Applicants: Hyunwoo Nho, Stanford, CA (US); Mohammad B. Vahid Far, San Jose, CA (US); Xiaofeng Wang, San Jose, CA (US)

(72) Inventors: Hyunwoo Nho, Stanford, CA (US); Mohammad B. Vahid Far, San Jose, CA (US); Xiaofeng Wang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 118 days.

(21) Appl. No.: 15/251,920

(22) Filed: Aug. 30, 2016

Related U.S. Application Data

(60) Provisional application No. 62/232,908, filed on Sep. 25, 2015.

(51) Int. Cl.
*G09G 3/20* (2006.01)

(52) U.S. Cl.
CPC ..... *G09G 3/2018* (2013.01); *G09G 2310/08* (2013.01)

(58) Field of Classification Search
None
See application file for complete search history.

(56) References Cited

U.S. PATENT DOCUMENTS

2009/0303161 A1* 12/2009 Messmer ..... G09G 3/14 345/55
2014/0168037 A1* 6/2014 Sakariya ..... G09G 3/3233 345/82

* cited by examiner

*Primary Examiner* — Nicholas J Lee
(74) *Attorney, Agent, or Firm* — Fletcher Yoder PC

(57) ABSTRACT

Systems and methods are provided for generating a nonlinear clock signal. Such a signal may be used to drive sub-pixels of an electronic display. The electronic display may include a microdriver that drives at least one sub-pixel based at least in part on an image data signal and an emission clock signal. The image data signal specifies a gray level for driving the sub-pixel and the emission clock signal includes a series of pulses of monotonically increasing pulse widths to enable the microdriver to drive the sub-pixel to emit light for a particular amount of time associated with the gray level. An emission timing controller may generate the emission clock signal.

14 Claims, 13 Drawing Sheets

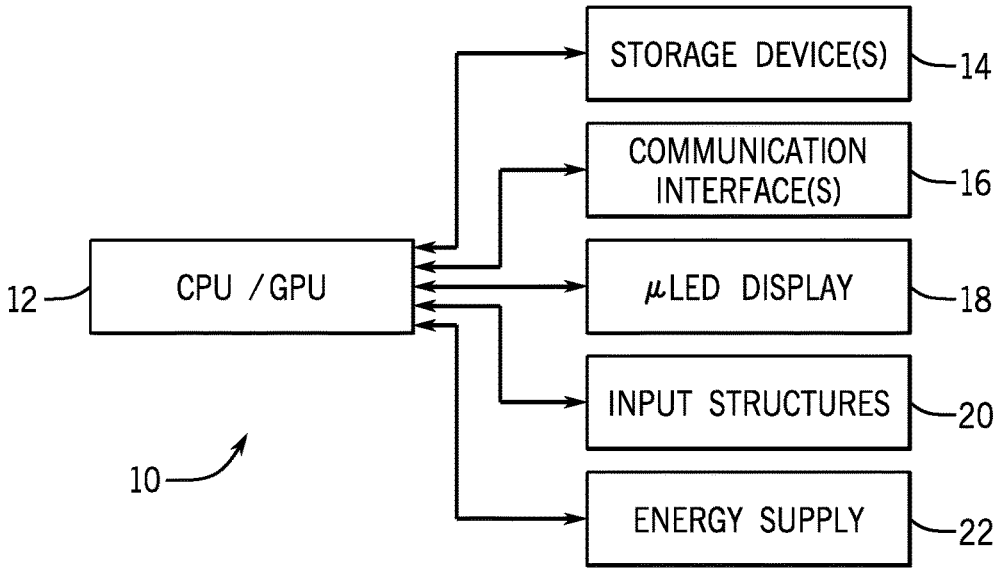
FIG. 1
FIG. 2
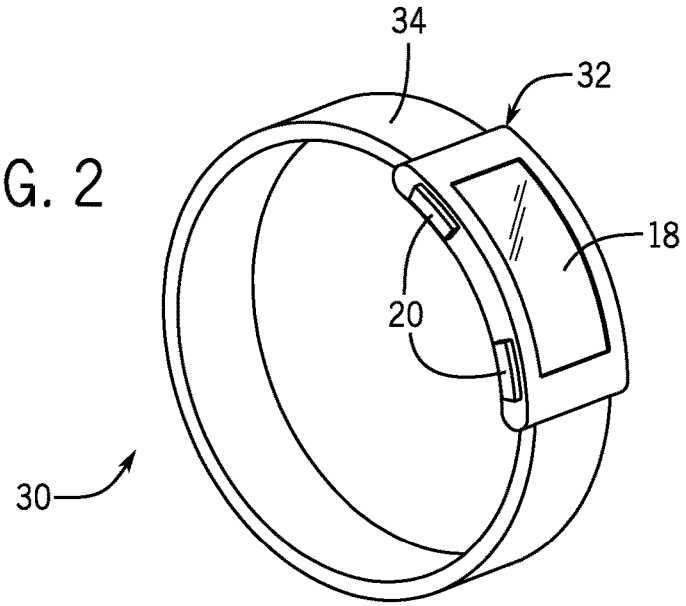

NONLINEAR PULSE-WIDTH-MODULATED CLOCK GENERATION

BACKGROUND

This disclosure relates to systems and methods for generating a pulse-width-modulated clock signal, such as a nonlinear pulse-width-modulated clock signal useful for driving sub-pixels of an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays are found in many electronic devices. Electronic displays may include a matrix of pixels, each of which includes sub-pixels of component colors. In one example, each pixel may include red, green, and blue sub-pixels. To generate pixels of particular colors, each sub-pixel may be driven to emit a particular amount of light. The human eye integrates the light from the sub-pixels and interprets the mix of light as a particular color. For example, a mix of light from red, green, and blue sub-pixels in a pixel may cause the pixel to appear to be white. The relative brightness of the sub-pixels may be programmed using image data. The image data may specify some specific level of brightness of each sub-pixel. This may be referred to as a gray level.

The human eye may notice relatively small changes in the amount of light emitted at relatively low gray levels. For relatively higher gray levels, however, a greater amount of change in brightness may take place before the human eye notices a change in brightness. As such, if the sub-pixels are driven to emit light for specific amounts of time based on a clock signal, a linear step change between gray levels may be unsuitable to achieve all of the gray levels used for displaying image data. Thus, a linear clock signal may be unsuitable to produce enough gray levels to display image data.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure provides systems and methods for generating a nonlinear pulse-width-modulated (PWM) emission clock signal sufficient to drive sub-pixels of an electronic display to all desired gray levels. Indeed, the emission clock signal may enable sub-pixels to be driven for shorter periods of time at low gray levels and for comparatively longer periods of time at higher gray levels. For example, an emission clock generator may include circuitry that includes a number of pulse-generating cell circuits, each of which may emit a pulse that starts and ends at different particular points in time. For example, a first pulse-generating cell may generate a pulse from a time t0 to t1, a second pulse-generating cell may generate a pulse from a later time t2 to t3, and so forth. These pulses may be combined (e.g., using some combination logic, such as an OR gate). The resulting combined signal may be a non-linear PWM clock signal. The pulse timing may be defined for certain sub-pixel colors to effectively provide a gamma encoding of image data to be displayed via the sub-pixel. That is, by designing the circuitry to cause the pulse-generating cells to emit the pulses at particular points in time (e.g., t0, t1, t2, t3, and so forth), the resulting emission clock may provide a nonlinear gamma encoding for the various gray levels. That is, by selecting pulses of relatively short duration for the early pulses and pulses of relatively longer duration for the later pulses, the amount of light emitted by a sub-pixel that is driven based on the emission clock signal may be perceptible by the human eye. Additionally or alternatively, pulses of the different pulse widths and start times may be generated by cells of a delay-locked loop (DLL) and combined to form the emission clock signal.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 1 is a block diagram of components of an electronic device that may include a micro light emitting diode (μ-LED) display, in accordance with an embodiment;

FIG. 2 is a perspective view of the electronic device in the form of a fitness band, in accordance with an embodiment;

DETAILED DESCRIPTION

Figure 3:
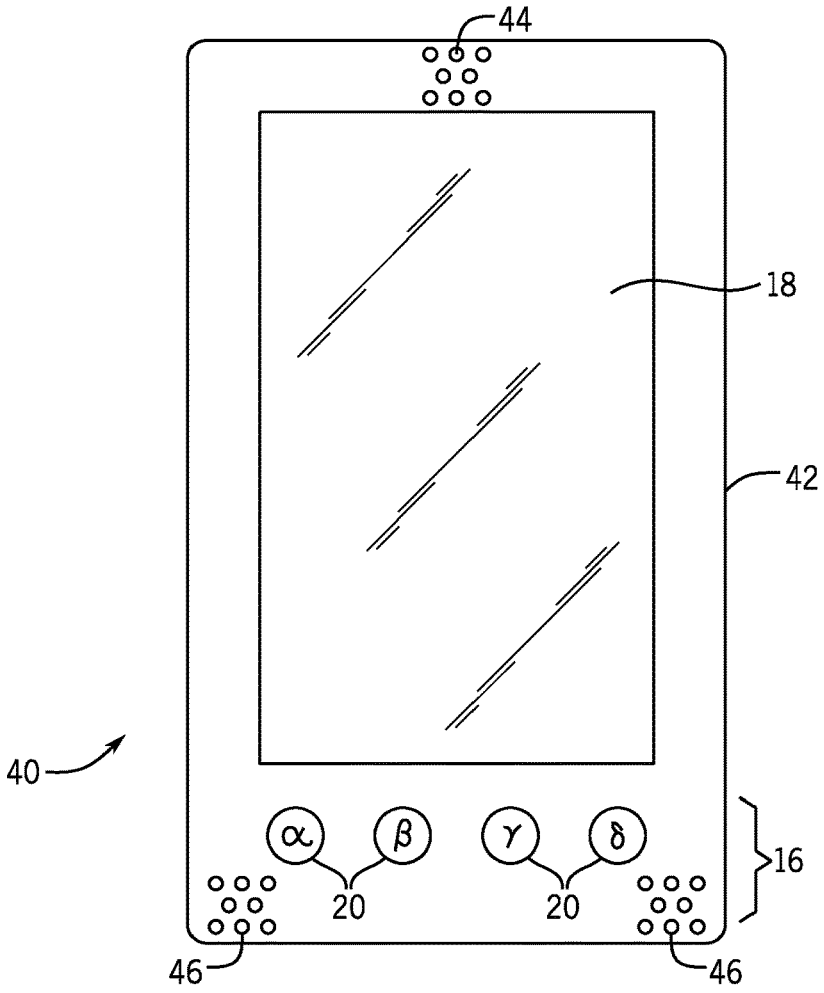
FIG. 3 is a front view of the electronic device in the form of a slate, in accordance with an embodiment.
Figure 4:
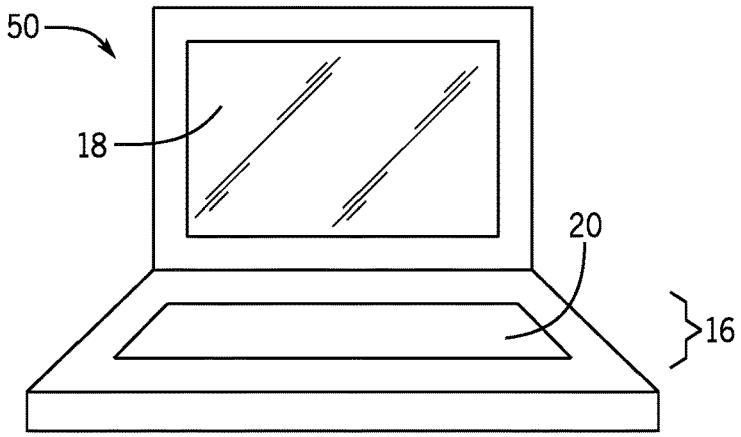
FIG. 4 is a perspective view of the electronic device in the form of a notebook computer, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A clock emission signal for an electronic display may be a nonlinear pulse-width-modulated (PWM) clock signal. The clock emission signal may have pulses that vary, allowing the electronic display to drive sub-pixels of the electronic display to all desired gray levels. In short, the emission clock signal may enable the sub-pixels to be driven for shorter periods of time at lower gray levels and for comparatively longer periods of time at higher gray levels. This allows the emission clock to provide a nonlinear gamma encoding for the various gray levels. That is, by selecting pulses of relatively short duration for the early pulses and pulses of relatively longer duration for the later pulses, the amount of light emitted by a sub-pixel that is driven based on the emission clock signal may be perceptible by the human eye.

An emission clock generator may include circuitry that generates the emission clock signal in any suitable number of ways. For example, an emission clock generator may include circuitry that includes a number of pulse-generating cell circuits, each of which may emit a pulse that starts and ends at different particular points in time. For example, a first pulse-generating cell may generate a pulse from a time t0 to t1, a second pulse-generating cell may generate a pulse from a later time t2 to t3, and so forth. These pulses may be combined (e.g., using some combination logic, such as an OR gate). The resulting combined signal may be a nonlinear PWM clock signal. Additionally or alternatively, pulses of the different pulse widths and start times may be generated by cells of a delay-locked loop (DLL) and combined to form the emission clock signal. The emission clock signal may be used to drive sub-pixels of a micro-LED display.

Suitable electronic devices that may include a micro-LED (μ-LED or u-LED) display are discussed below with reference to FIGS. 1-4. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement of pixels made up of μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

As may be appreciated, the electronic device 10 may take a number of different forms. As shown in FIG. 2, the electronic device 10 may take the form of a fitness band 30. The fitness band 30 may include an enclosure 32 that houses the electronic device 10 components of the fitness band 30. A strap 30 may allow the fitness band 30 to be worn on the arm or wrist. The display 18 may display information related to the operation of the fitness band 30. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device, such as a mobile phone, or a tablet-sized device. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
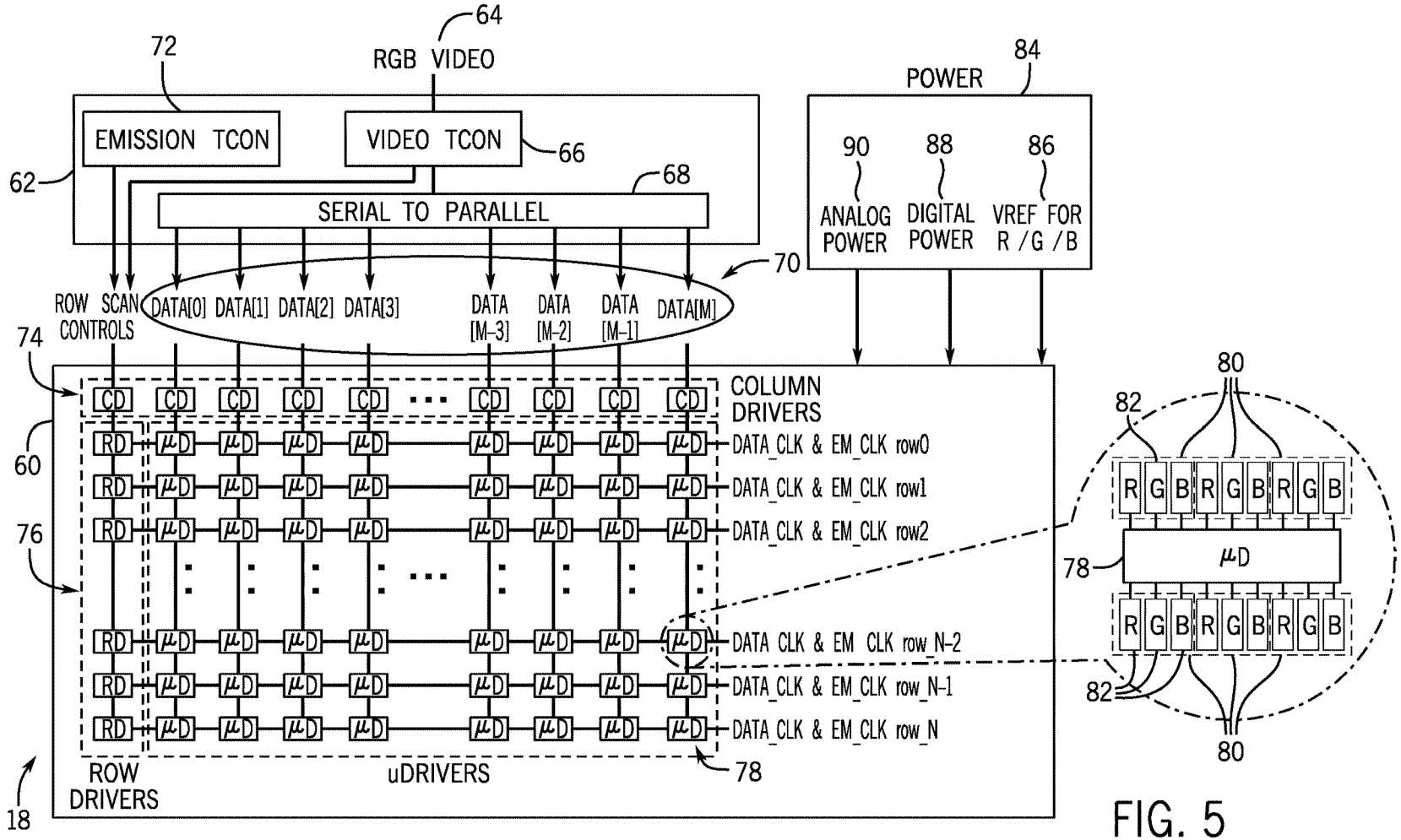
FIG. 5 is a block diagram of a μ-LED display that employs micro-drivers (μDs) to drive μ-LED sub-pixels with control signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as sub-pixels. Support circuitry 62 thus may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[2], DATA[3] . . . DATA[M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 shown in FIG. 5 includes column drivers (CDs) 74, row drivers (RDs) 76, and micro-drivers (μDs or uDs) 78. Each uD 78 drives a number of pixels 80 having μ-LEDs as sub-pixels 82. Each pixel 80 includes at least one red μ-LED, at least one green μ-LED, and at least one blue μ-LED to represent the image data 64 in RGB format. Although the μDs 78 of FIG. 5 is shown to drive six pixels 80 having three sub-pixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, sub-pixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED sub-pixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of μDs 78 may be activated when the RD 76 that controls that row sends the data clock signal (DATA_CLK). This may cause the now-activated μDs 78 of that row to receive and store the digital image data 70 signal that is driven by the column drivers (CDs) 74. The μDs 78 of that row then may drive the pixels 80 based on the stored digital image data 70 signal based on the emission clock signal (EM_CLK).

Figure 6:
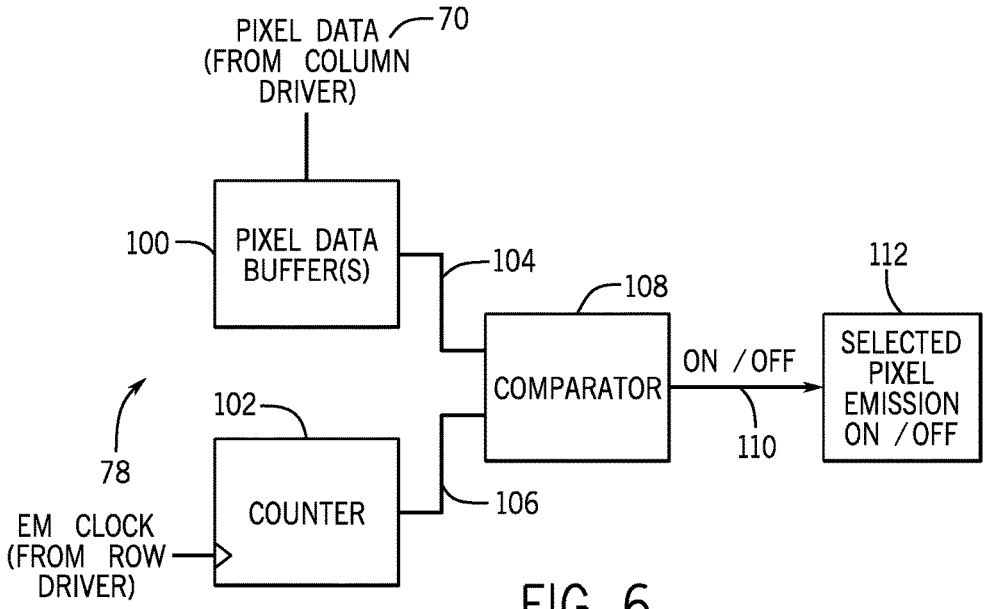
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include enough pixel data buffer(s) 100 to store image data 70 for three sub-pixels 82 at any one time (e.g., for 8-bit image data 70, this may be 24 bits of storage). It should be appreciated, however, that the pixel data buffer(s) 100 may include more or fewer buffers, depending on the data rate of the image data 70 and the number of sub-pixels 82 included in the image data 70. Thus, in some embodiments, the pixel data buffer(s) 100 may include as few buffers as to hold image data for one sub-pixel 82 or as many as suitable (e.g., 4, 5, 6, 7, 8, 9, 10, 11, 12, and so forth). The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular sub-pixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the sub-pixel 82 being driven, which may cause light emission 112 from the selected sub-pixel 82 to be on or off. The longer the selected sub-pixel 82 is driven "on" by the emission control signal 110, the greater the amount of light that will be perceived by the human eye as originating from the sub-pixel 82.

Figure 7:
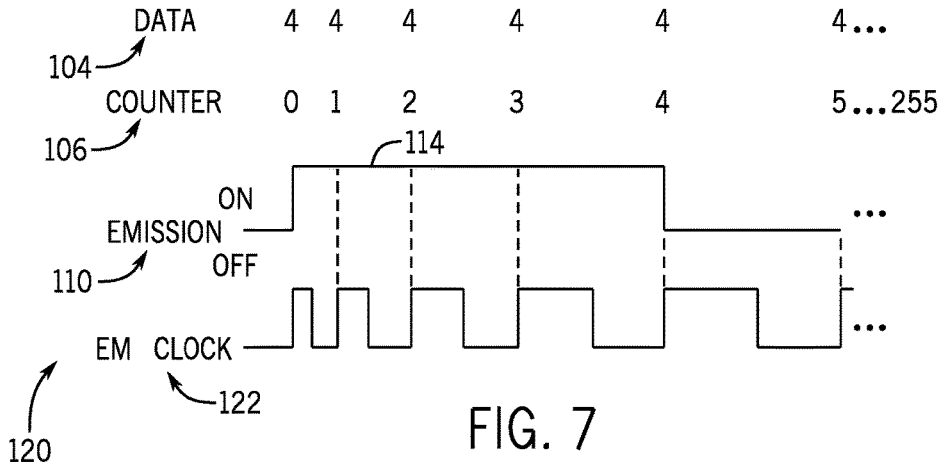
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected sub-pixel 82 is gray level 4, and this is reflected in the digital data signal 104. The emission control signal 110 drives the sub-pixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected sub-pixel 82 no longer to emit light.

Figure 8:
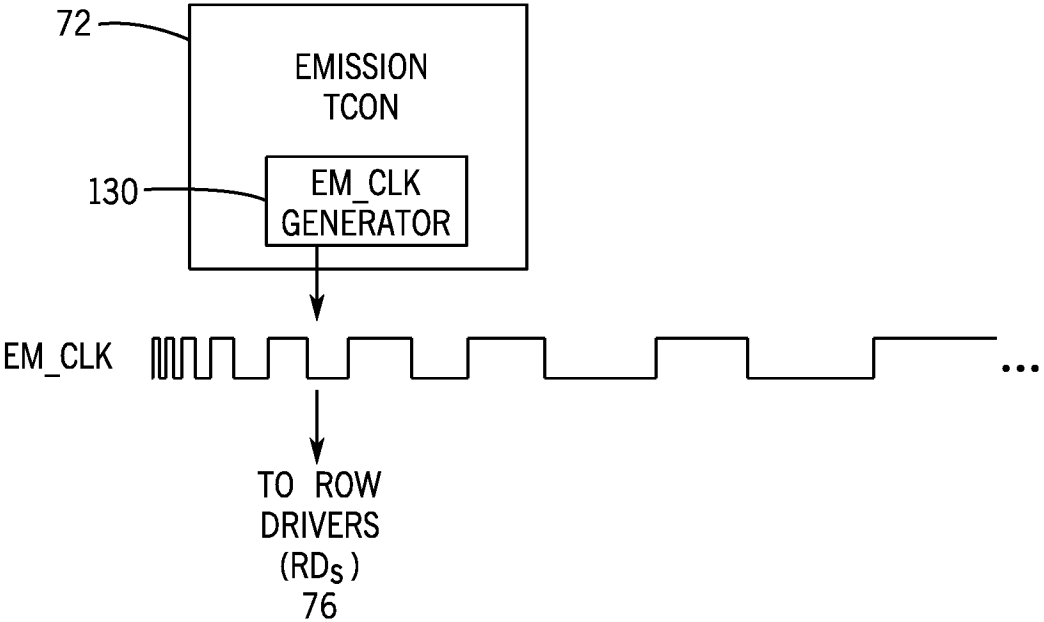
FIG. 8 is an example of an emission clock signal (EM_CLK) generated by an emission clock generator, in accordance with an embodiment.

As shown in FIG. 8, the emission TCON 72 may include at least one emission clock generator (EM_CLK generator) 130. As may be appreciated, the emission TCON 72 may include multiple emission clock generators 130, which may be used to produce multiple phases of the emission clock signal (EM_CLK). The emission clock signals (EM_CLK) may be provided to the row drivers (RDs) 76. As discussed above, the emission clock signals (EM_CLK) may be provided by the row drivers (RDs) 76 to the micro drivers (μDs) 78 to drive individual sub-pixels 82 for specified amounts of time. The longer a particular sub-pixel 82 is driven, the greater the amount of light that is emitted by that sub-pixel 82. The light emitted by the sub-pixel 82 may be integrated by the human eye; as such, a sub-pixels 82 driven for a longer period of time may appear brighter and may contribute more of the light of the particular color that is emitted by that sub-pixel 82. The emission clock signal (EM_CLK) may provide a nonlinear gamma encoding for the various gray levels that the sub-pixels 82 may be driven to. By providing pulses of relatively short duration for the early pulses and pulses of relatively longer duration for the later pulses of the emission clock signal, changes in gray level for the amount of light emitted by a sub-pixel 82 that is being driven may be perceptible by the human eye.

The emission clock generator 130 thus may generate a nonlinear pulse-width-modulated (PWM) clock signal. Moreover, the particular pulse widths for each pulse of the emission clock signal (EM_CLK) may be generated to provide the gamma encoding that is particular to a particular color of sub-pixel. In one example, one emission clock generator 130 may generate a first emission clock signal (EM_CLK) having pulse widths that provide the desired gamma encoding for driving red sub-pixels 82. A second emission clock generator 130 may generate a second emission clock signal (EM_CLK) having different pulse widths to produce a desired gamma encoding for driving green or blue sub-pixels 82.

The pulses of the emission clock signals (EM_CLK) may have a relatively wide dynamic range between the shortest pulse at the start of one emission clock signal (EM_CLK) (e.g., the shortest pulse of the emission clock signal used for driving the red sub-pixels 82) and the longest pulse at the end of one of the emission clock signals (EM_CLK) (e.g., the longest pulse of the emission clock signal used for driving the green or blue sub-pixels 82). The emission clock signal (EM_CLK) used for driving the red sub-pixel 82 may have a first pulse (corresponding to a gray level 1) as rapid as 10 ns. On the other hand, an emission clock signal (EM_CLK) used for the driving green or blue sub-pixels 82 may have a longest emission clock pulse (corresponding to a highest gray level) that may take up to 10-20% of a frame update rate (e.g., on the order of milliseconds).

One way that the emission clock generator 130 may generate the emission clock signal (EM_CLK) may be a digital counting approach, but this may be relatively costly due to the wide dynamic range. To generate the emission clock signal (EM_CLK) using a digital counting approach, a high-frequency reference clock that is at least as fast as the shortest pulse of the emission clock signal (EM_CLK) may be counted. Pulses may be generated when certain total amounts of rising or falling edges of high-frequency reference clock signal have passed. A digital lookup table (LUT) may store 255 nonlinear counting numbers for 8-bit data the 255 gray levels represented by the emission clock signal (EM_CLK) in (for a bit digital image data). The shortest pulse (gray level 1) for an emission clock used for driving the blue or green sub-pixels 82 to may be on the order of 1 μs. As such, a reference clock frequency of approximately 80 MHz may be used. For driving the red sub-pixels 82, the shortest emission clock signal pulse (gray level 1) may be on the order of 10 ns. As such, the reference clock signal used to generate an emission clock signal for a red pixel may have a frequency of greater than 1 GHz. Since this may consume a substantial amount of energy, for higher gray levels, a lower-resolution reference clock signal may be used instead. For example, to generate the pulses for relatively lower gray levels, the emission clock generator 130 may count the pulses of a 1 GHz reference clock, while, for higher gray levels, pulses from a 100 MHz reference clock may be used.

As may be appreciated, using a digital pulse counting technique may cause the emission clock generator 130 to consume a substantial amount of power, given the high dynamic range between the shortest possible emission clock pulses that may be used by the display 18 and the longest possible emission clock pulses that may be used by the display 18. Thus, the following discussion will describe various other circuitry that may appear in the emission clock generator 130 to generate the emission clock signal (EM_CLK).

Figure 9:
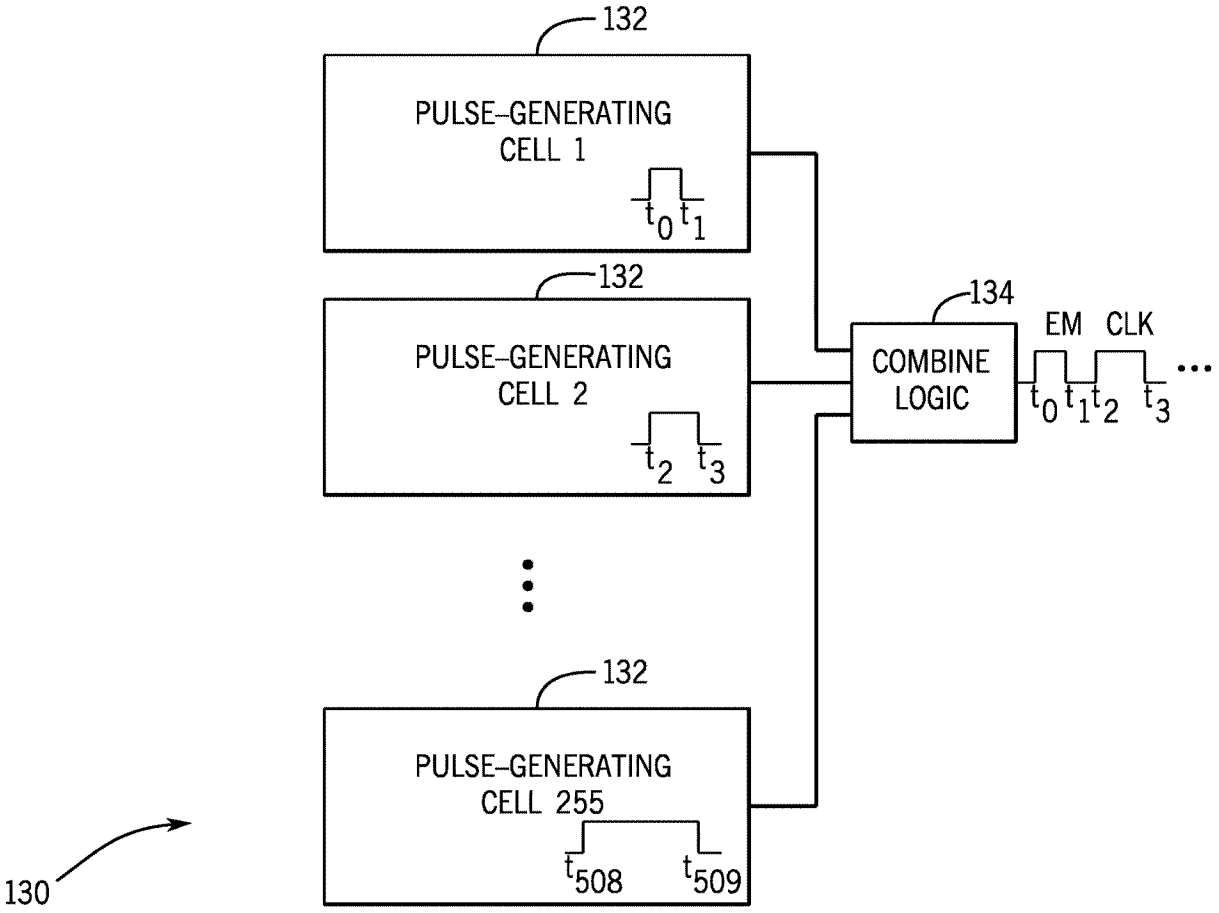
FIG. 9 is a block diagram of circuitry that may be included in the emission clock generator to produce pulses of varying duration and start time, which are combined together to form the emission clock signal (EM_CLK), in accordance with an embodiment.

FIG. 9 is a block diagram representing circuitry that may be used to produce the emission clock signal (EM_CLK). Specifically, the emission clock generator 130 may include some number of pulse-generating cells 132. In the example shown in FIG. 9, the emission clock generator 130 generates 255 pulses, thereby providing an emission clock signal (EM_CLK) with enough pulses for 1 pulse per gray level when 8-bit image data is used by the display 18. It should be appreciated, however, that the emission clock generator 130 may include more or fewer pulse-generating cells 132. For example, when half-rate counting is used by the micro-drivers (μDs) 78, meaning both rising and falling edges of the emission clock signals (EM_CLK) are counted, the same resolution of image data may be represented using an emission clock signal (EM_CLK) with fewer pulses. Under those circumstances, the emission clock generator 130 may include fewer pulse-generating cells 132.

Each pulse-generating cell 132 generates a pulse that starts and ends at a different time. For example, the first pulse-generating cell 132 may generate a pulse that starts at time t0 and ends at time t1, the second pulse-generating cell 132 generates a pulse that starts at time t2 and ends at time t3, and so forth. The individual pulses emitted by the pulse-generating cells 132 are combined together using any suitable form of combine logic 134 to produce the total emission clock signal (EM_CLK). Thus, the combine logic 134 may represent any logic that can sum the outputs of the pulse-generating cells 132. For example, the combine logic 134 may represent an OR gate or a tree of OR gates.

Figure 10:
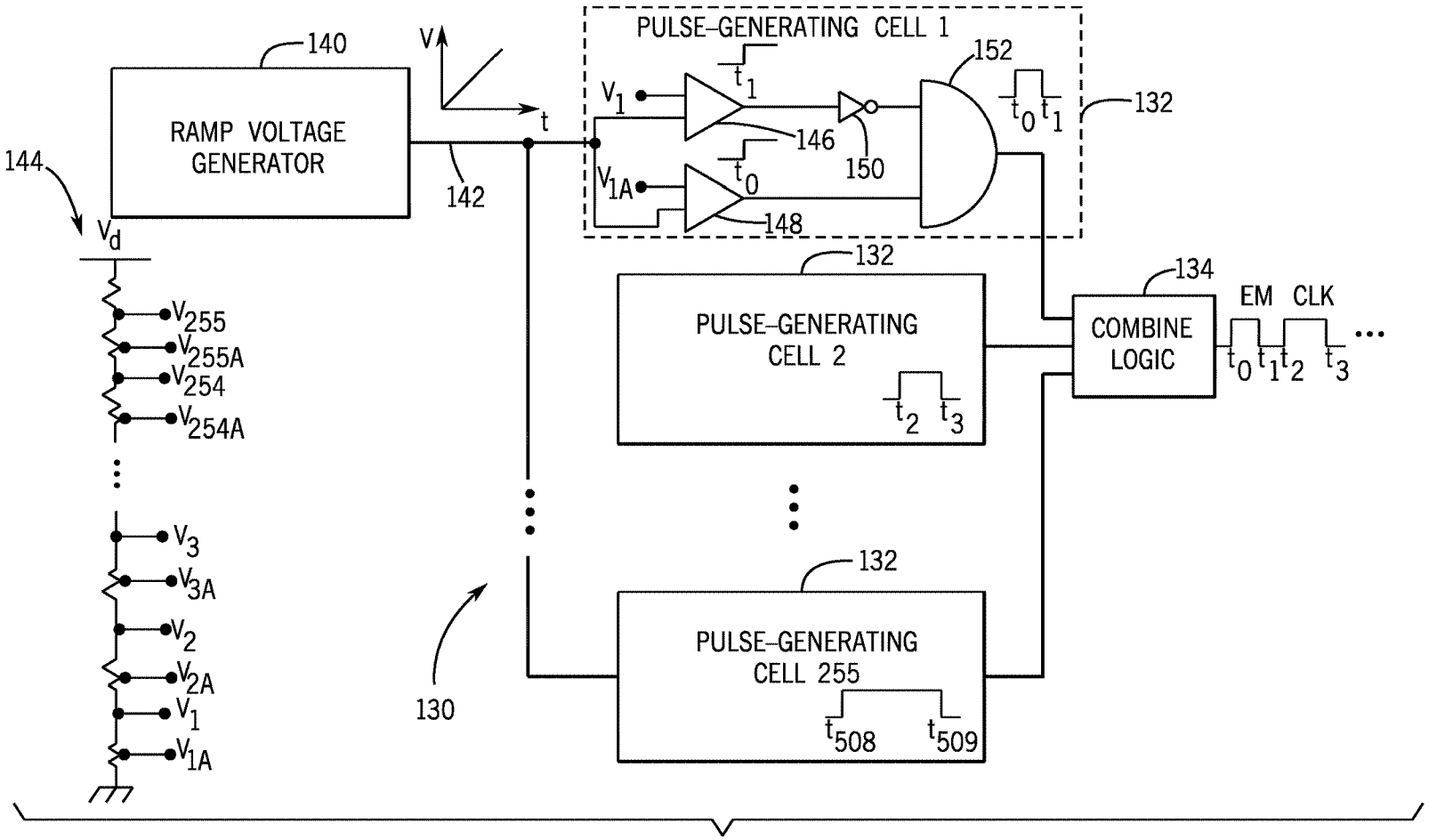
FIG. 10 is a diagram of circuitry that may appear in the emission clock generator, which generates the different pulses by comparing a ramp voltage to different reference voltages, in accordance with an embodiment.

The pulse-generating cells 132 may use any suitable circuitry to generate individual pulses at specific points and time. One example of such circuitry is shown in FIG. 10. FIG. 10 illustrates one particular implementation of the emission clock generator 130 that uses a common ramp voltage generator 140 to generate a common ramp voltage 142 that is used by the pulse-generating cells 132. In particular, the pulse-generating cells 132 shown in FIG. 10 may use the ramp voltage 142 to determine when to start and stop the individual pulses that the pulse-generating cells 132 respectively emit. In the example of FIG. 10, any suitable circuitry to generate reference voltages, such as a voltage resistor ladder 144, may be used.

In the voltage resistor ladder 144 shown in FIG. 10, there are 510 reference voltages, 2 for each pulse-generating cell 132. In the example of the first pulse-generating cell 132, the ramp voltage 142 that is produced by the ramp voltage generator 140 enters two comparators 146 and 148. A first reference voltage V1A is the reference voltage to the comparator 148, and a second reference voltage V1, which is higher than the first reference voltage V1A, is the reference voltage supplied to the comparator 146.

While the ramp voltage 142 is less than both V1A and V1, the output of the comparator 148 will be a logical low and the output of the comparator 146 will be a logical low. An inverter 150 that receives the output of the comparator 146 thus may output a logical high signal. An AND gate 152 that receives the output of the comparator 148 and the inverter 150 thereby outputs a logical low signal as long as the ramp voltage 142 is less than both V1A and V1. The reference voltage V1A may be selected so the ramp voltage 142 will reach V1A at a time t0. This causes the comparator 148 to emit a logical high signal at time t0. Thus, while the ramp voltage 142 is greater than V1A but less than V1, the output of the inverter 150 remains high, and the AND gate 152 starts to emit a logic high signal at t0. The reference voltage V1 may be selected such that the ramp voltage 142 reaches the reference voltage V1 at a t1. As such, when the ramp voltage 102 crosses the threshold of the reference voltage V1 at time t1 the comparator 146 may output a logic high signal, which is inverted by the inverter 150, causing the inputs to the AND gate 152 to be a logical high from the comparator 148, but a logical low from the inverter 150, thereby causing the output of the AND gate 152 to return to a logical low at time t1.

Similar circuitry may be used in the other pulse-generating cells 132, with different reference voltages selected to be reached by the ramp voltage 142 at different times. For example, a second pulse-generating cell 132, which emits a pulse that starts a time t2 and ends at time t3, may use reference voltages V2A and V2.

Figure 11:
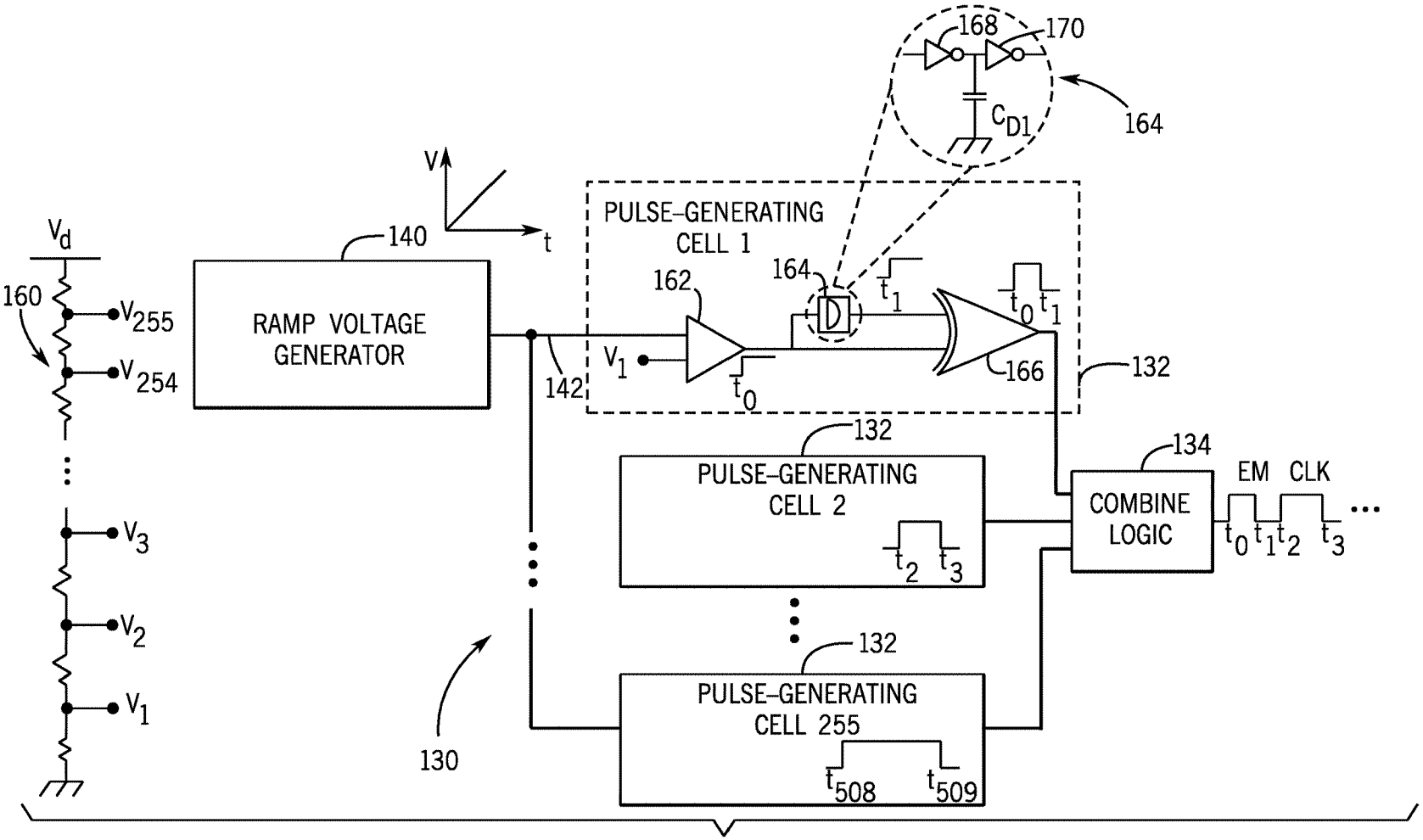
FIG. 11 is a diagram of circuitry that may appear in the emission clock generator, which uses a ramp voltage and a delay cell to generate the pulses, in accordance with an embodiment.

Another example of circuitry that may appear in the emission clock generator 130 is shown in FIG. 11. In the example of FIG. 11, a fewer reference voltages may be involved. As in the circuitry discussed above with reference to FIG. 10, any suitable reference-voltage-generating circuitry may be used, including a voltage resistor ladder 160. The voltage resistor ladder 160 may include one reference voltage per pulse-generating cell 132.

An example of circuitry that may be used by the pulse-generating cells 132 example of FIG. 11 is shown in the first pulse-generating cell 132. The first pulse-generating cell 132 has a comparator 162 with the voltage V1 as its reference voltage. The reference voltage V1 may be designed (e.g., in the design of the voltage resistor ladder 160) so that the ramp voltage 142 reaches V1 at a time t0. When the ramp voltage 142 reaches the reference voltage V1 at time t0, the comparator voltage 162 may emit a logical high signal. The logical high signal may enter a delay circuit 164 and an XOR logic gate 166. The delay circuit 164 may delay the passing of the logical high signal, and thus continue to output a logical low signal, until time t1. As such, between the time that the comparator 162 emits the logical high pulse at time t0 and when the delay circuit emits a logical high signal at time t1, the XOR logic gate 166 may emit a pulse.

The delay circuit 164 may delay the arrival of the received pulse from the comparator 162 to the second input of the XOR logic gate 166 using in any suitable way. One example of the delay circuit 164, shown in close view in FIG. 11, uses a grounded capacitor CD1 that is disposed between two inverters 168 and 170. Depending on the value of the capacitor CD1, the amount of delay between receipt of the high pulse and the passing on of the high pulse may be tuned. As may be appreciated, the pulse-generating cells 132 of the emission clock generator 130 of FIG. 11 thus may emit pulses at certain specific times and for specific durations based on their respective reference voltages (e.g., V1, V2, etc.) and the capacitance values of their respective delay circuits 164.

The ramp voltage generator 140 represented as a block diagram in FIGS. 10 and 11 may include any suitable circuitry to generate a desired ramp voltage 142. The ramp voltage generator 140 may generate a single-slope ramp voltage, as in the example described by FIGS. 12 and 13, or a segmented ramp voltage, as in the example described by FIGS. 14 and 15. It should be appreciated that the examples of FIGS. 12-15 are meant to be non-exhaustive examples of ramp voltage generators 140. Indeed, any suitable ramp voltage circuitry that generates any suitable ramp voltage—whether the ramp voltage is linear (e.g., single-slope), segmented (e.g., multi-slope), or some nonlinearly shaped ramp voltage.

Figure 12:
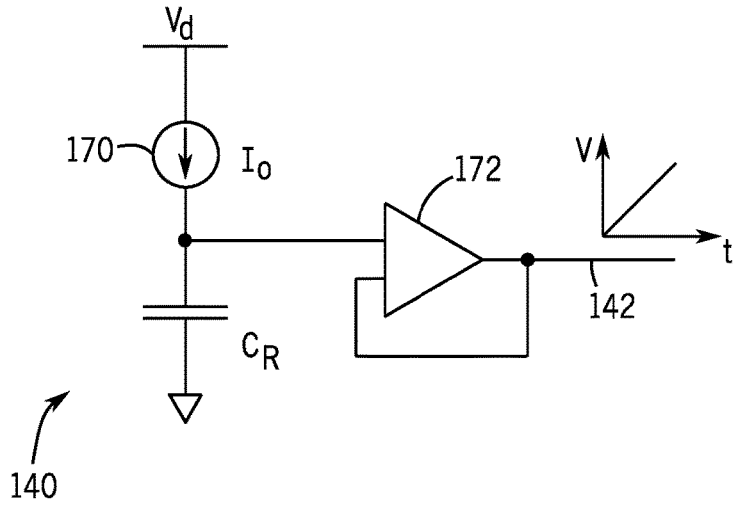
FIG. 12 is a diagram of circuitry that may be used to generate the ramp voltage, in accordance with an embodiment.

The example of the ramp voltage generator 140 shown in FIG. 12 includes a current source 170 that generates a substantially constant reference current I0. The reference current I0 feeds into a capacitor Cr. A buffer 172 outputs the voltage on the node between the current source 170 and the capacitor Cr. The output of the buffer 172 is the ramp voltage 142.

Figure 13:
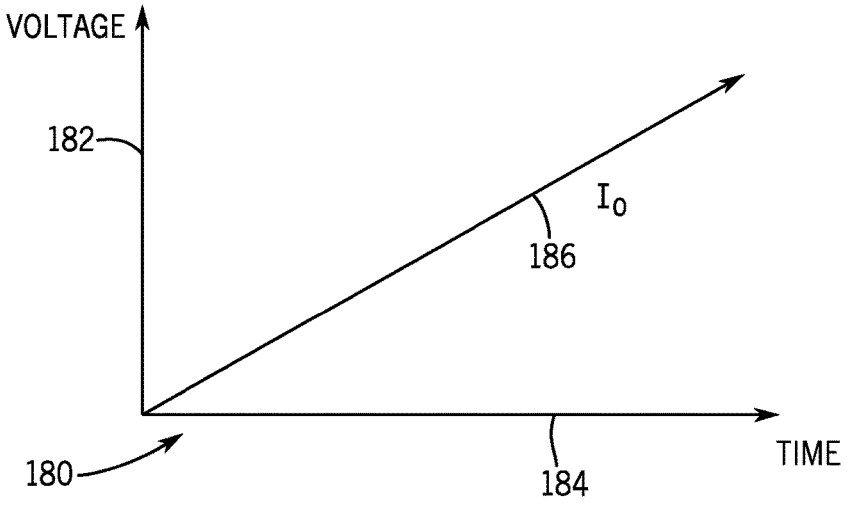
FIG. 13 is a plot showing the ramp voltage output by the circuitry of FIG. 12, in accordance with an embodiment.

A plot 180 of FIG. 13 represents an example of the linear ramp voltage 142 that is output by the ramp voltage generator 140 of FIG. 12. An ordinate 182 represents increasing voltage and an abscissa 184 represents increasing time. A curve 186 illustrates the substantially constant slope of the ramp voltage 142. This may be due to the substantially constant reference circuit I0 feeding into the capacitor Cr shown in the circuitry of FIG. 12.

Figure 14:
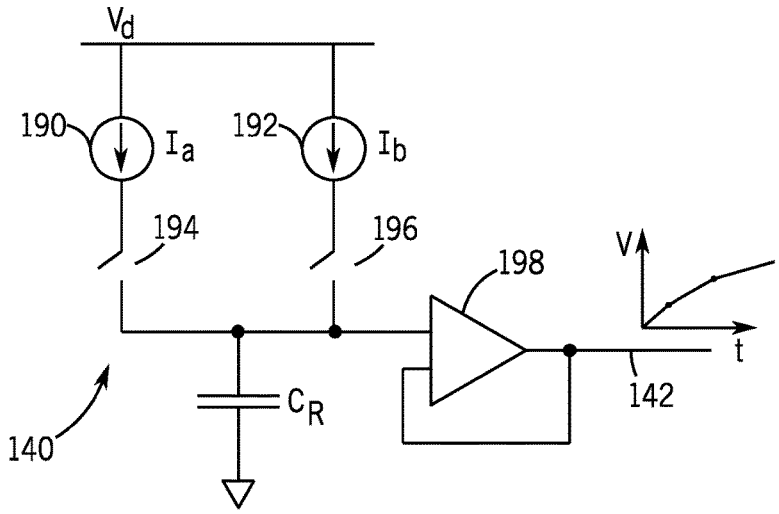
FIG. 14 is a diagram of circuitry that may used to generate a segmented ramp voltage, in accordance with an embodiment.

A segmented ramp voltage 142 may be generated by the example of the ramp voltage generator 140 shown in FIG. 14. In the example of FIG. 14, multiple current sources (here, current sources 190 and 192) produce different respective reference currents (here, Ia and Ib, respectively). It should be appreciated that any suitable number of reference current sources and corresponding reference currents may be used. Using two current sources, as in FIG. 14, is meant to be one example, and is not intended to be exhaustive. Switches 194 and 196 may selectively provide the reference current Ia and/or Ib into the capacitor Cr. As the referenced current(s) Ia and/or Ib charge the capacitor Cr, the voltage on the node connected to the capacitor Cr may ramp. A buffer 198 may use the voltage on this node as a reference voltage, outputting a segmented ramp voltage 142.

Figure 15:
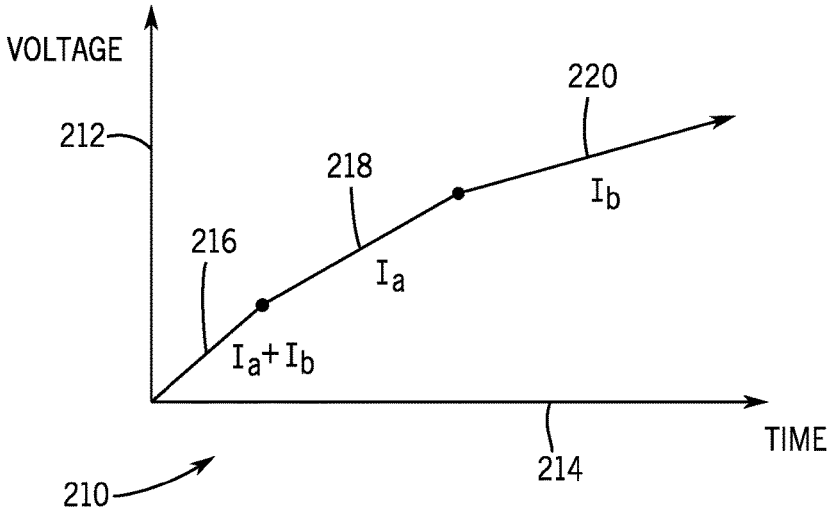
FIG. 15 is a plot showing the segmented ramp voltage output by the circuitry of FIG. 14, in accordance with an embodiment.

A plot 210 on FIG. 15 represents an example of the segmented ramp voltage 142. An ordinate 212 represents voltage in relation to an abscissa 214, which represents time. As shown in the plot 210, there may be three segments 216, 218, and 220. The segment 216 has the steepest slope and is due to the closing of both switches 194 and 196, thereby providing a sum of both the references currents Ia and Ib into the capacitor Cr. The segment 218 is slightly less steep and may occur when the switch 194 is closed, but the switch 196 is open, and the reference current Ia feeds into the capacitor Cr. When the reference current Ib is less than the reference current Ia, the slope of the third segment 220, which includes only the result of the reference current Ib feeding into the capacitor Cr. In this case, the switch 196 is closed and the switch 194 is open. As may be appreciated, by selecting the size of the capacitor Cr and the strengths of the reference currents Ia and Ib, as well as the timing for switching the switches 194 and 196, a variety of different segmented ramp voltages 142 may be generated.

Figure 16:
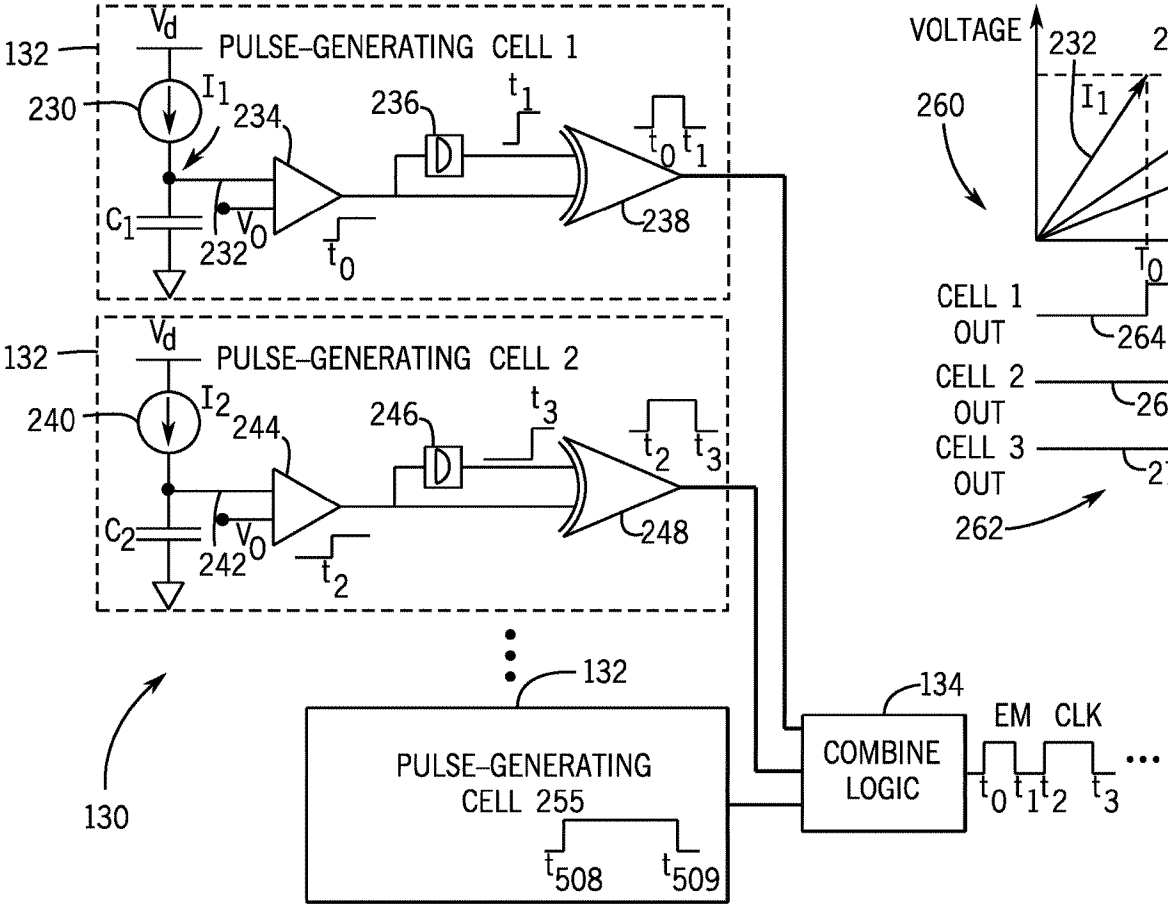
FIG. 16 is a diagram of circuitry that may appear in the emission clock generator, which uses multiple ramp voltages and a delay circuit to generate the pulses of the emission clock signal (EM_CLK), in accordance with an embodiment.

FIG. 16 represents another example of circuitry that may appear in the emission clock generator 130. In the example of FIG. 16, the pulse-generating cells of 132 use different respective ramp voltages generated specifically for that cell 132. For example, the first pulse-generating cell 132 may include a first current source 230 that generates a first reference current I1. The reference current I1 charges a capacitor C1 and generates a ramp voltage 232 at the node between the capacitor and the current source 230. As should be appreciated (and as will be discussed below with reference to FIG. 17) the slope of the ramp voltage 232 may be defined by the selected values of the reference current I1 and the capacitor C1. The ramp voltage 232 enters a comparator 234, which emits a logically high signal when the ramp voltage 232 exceeds some reference voltage V0. The reference voltage V0 and the ramp voltage 232 may be designed to cause the comparator 234 to emit the logical high signal at time t0. The output of the comparator 234 goes to a delay circuit 236 and as one input into an XOR logic gate 238. The output of the delay circuit 236 is a second input into the XOR logic gate 238. The delay circuit 236 may be any suitable delay circuit, including the delay circuit described above with reference to FIG. 11. Before time T0, the comparator 234 outputs a logical low as does the delay circuit 236. As such, the XOR logic gate 238 also outputs a logical low. At time T0, the input of the delay circuit 236 is logically high, put the output of the delay circuit 236 will be logically low until some delay time passes and the logical high signal is allowed through the delay circuit 236, occurring at time T1. Thus, between time T0 and time T1, only one input to the XOR logic gate 238 is a logical high signal. As a result, between time T0 and T1, the XOR logic gate 238 emits a pulse.

Similarly, in the second pulse-generating cell 132 shown in FIG. 16, a current source 240 generates a different reference current I2 that charges a different capacitor C2. The resulting voltage on the node is a ramp voltage 242. The values of the reference current I2 and capacitor C2 may be selected so that the ramp voltage 242 crosses the threshold of the reference voltage V0 at a time t2. In this way, when a comparator 244 detects that the ramp voltage 242 exceeds the reference voltage V0, the comparator 244 emits a logical high signal. The output of the comparator 244 enters a delay circuit 246 and one input of a XOR logic gate 248. The output of the delay circuit 246 feeds into another input of the XOR logic gate 248. The delay circuit 246 may be sized to delay the logical high signal from passing through the delay circuit 246 until a time t3. Thus, between times t2 and t3, the XOR logic gate 248 emits a logical high pulse. The combined logic 134 of the emission clock generator 130 may combine these pulses into the emission clock signal (EM_CLK).

Although the example of FIG. 16 uses the same reference voltage V0 for multiple pulse-generating cells 132, it should be appreciated that different cells may use different reference voltages and/or the ramp voltages of different slopes (e.g., 232, 242) may be repeated in further pulse-generating cells 132 with different ramp voltages. For example, the first 3 pulse-generating cells 132 may use the same reference voltage V0, but generate 3 different ramp voltages of different slope, while the next 3 pulse-generating cells 132 (i.e., cells 4, 5, and 6) may use the same ramp voltages used in the first, second, and third pulse-generating cells 132 respectively, but use reference voltages higher than the reference voltage V0. Such a pattern may repeat throughout the pulse-generating cells 132. Additionally or alternatively, the reference voltages V0 may be identical through all of the pulse-generating cells 132, but the slopes of the ramp voltages of each pulse-generating cell 132 may be lower.

Figure 17:
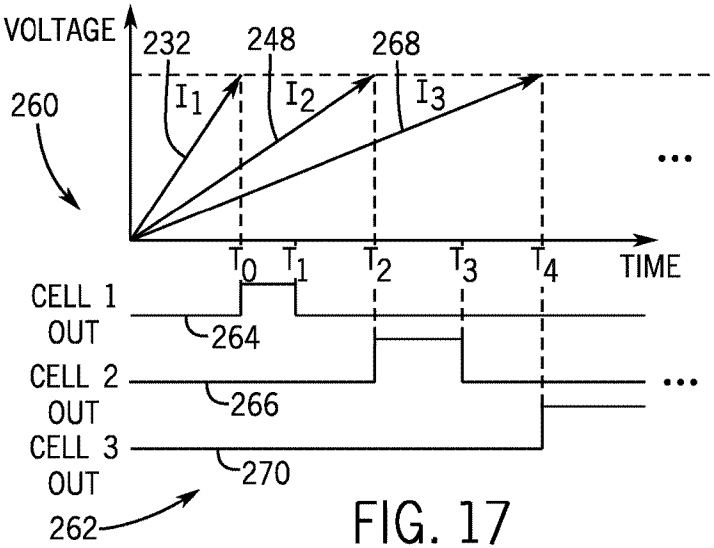
FIG. 17 is a timing diagram illustrating the generation of different pulses using the circuitry of FIG. 16, in accordance with an embodiment.

FIG. 17 illustrates a timing diagram that describes the operation of the emission clock generator 130 described in FIG. 16. In FIG. 17, a voltage N-time plot 260 is disposed over a signal timing diagram 262. The slope of the ramp voltage 232 is relatively steep and reaches the reference voltage t0 at time t0 causing the cell 1 output to pulse, as shown by a signal 264. The slope of the ramp voltage 242 is relatively lower, and reaches the reference voltage V0 at a time t2, causing the cell to output to pulse at time t2, this is shown by a signal 266. Another ramp voltage 268 due to a third reference current I3, has yet a lower slope. As a result, the ramp voltage 268 reaches V0 even later, at time t4. When the ramp voltage 268 is used in the third pulse-generating cells 132, the cell 3 output pulses at time t4. This is shown by a signal 270.

Figure 18:
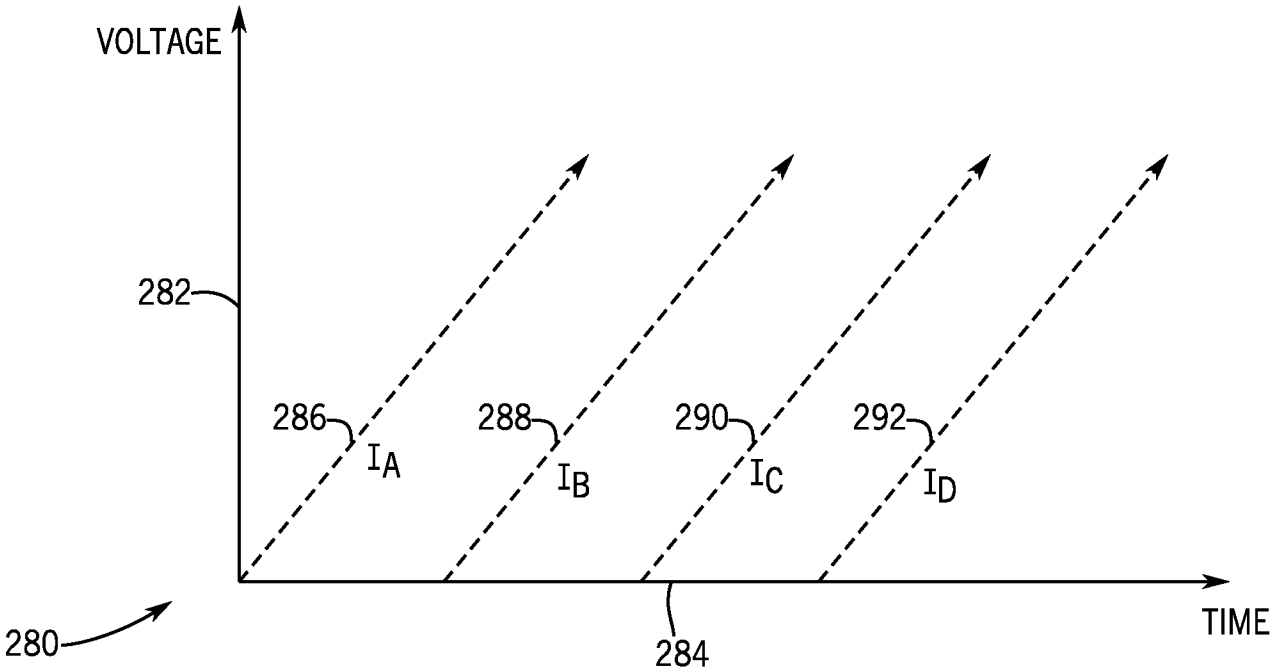
FIG. 18 is a plot illustrating the use of different phases of a multi-phase clock signal to produce multiple ramp voltages at different times for generating multiple phases of the emission clock signal (EM_CLK), in accordance with an embodiment.

It should be appreciated that multiple emission clock signals (EM_CLK) may be provided to the display 18 by the emission TCON 72. As shown by a plot 280 in FIG. 18, which includes an ordinate 288 representing voltage and an abscissa 284 representing time, multiple ramp voltages may be generated for multiple emission clock phases in the circuitry discussed above. Indeed, this may allow for excellent matching between phases of a multiple phases of emission clock signals (EM_CLK) generated by the emission TCON 72. Indeed, using the circuitry discussed above with reference to FIGS. 9-17, ramp voltages may be generated in parallel integrators. The comparators and logic of the circuitry described by FIGS. 9-17 could be shared to enable the generation of multiple phases of emission clock signals (EM_CLK) by adding switches and suitable logic to generate and route particular pulses to different combined logic 134, as should be appreciated. In other words, the particular ramp voltage that is applied to a particular cell 132 may be switched over time to enable the pulse-generating cell 132 to operate to generate a pulse for a different phase emission clock signal (EM_CLK). Considering the plot 280 of FIG. 18, 4 ramp voltages are shown that may be used to generate 4 phases of emission clock signal (EM_CLK). A first ramp voltage 286 may be generated by a first current Ia in a first ramp voltage generator, a second ramp voltage 288 may be generated via a reference current Ib in a second voltage ramp generator 140, a third ramp voltage 290 may be generated by a third reference current Ic in a third reference voltage generator 140, and a fourth reference voltage may be generated by a fourth reference current Id in a fourth reference voltage generator 140. The ramp voltages 286, 288, 290, and 292 may be multiplexed into the appropriate pulse-generating cells 132, and the respective outputs of the pulse-generating cells 132 may also be multiplexed to the appropriate combined logic 134 to generate the 4 phases of emission clock signals (EM_CLK). Additionally or alternatively, multiple copies of the emission clock generators 130 may be included in the emission TCON 72.

Figure 19:
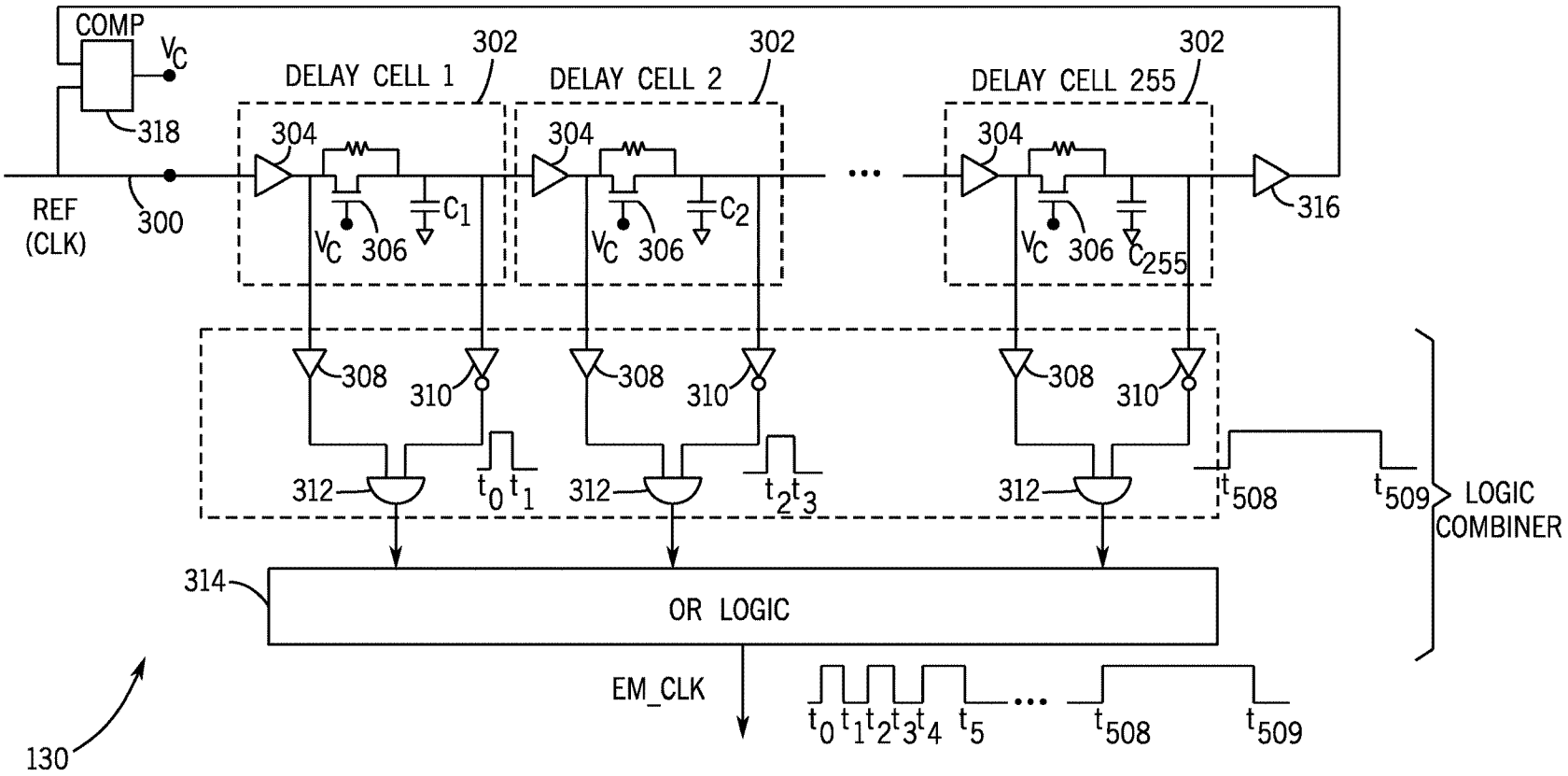
FIG. 19 is a diagram of circuitry that may appear in the emission clock generator, which uses a series of delay cells to produce the pulses of the emission clock signal (EM_CLK), in accordance with an embodiment.

Another form of circuitry that may appear in the emission clock generator 130 is a delay-locked loop (DLL). As shown in FIG. 19, a reference (e.g., a clock signal) 300 may be an input into a first delay cell 302, the delay cells 302 may be connected together in a delay-locked loop that continues until the final delay cell 302, repeating periodically depending on the input reference (CLK) signal 300. Each delay cell 302 may include an input buffer 304 that receives the reference input signal from the previous delay cell 302. The signal from the buffer 304 is provided to an RC circuit defined by some resistor R and a capacitor C1. In other embodiments, the amount of delay in each delay cell 302 may be any suitable LC circuit or RLC circuit. A clear switch 306 may be used to clear each delay cell 302 to reset the delay-locked loop shown in FIG. 19 when the emission clock signal (EM_CLK) has been generated. During the emission-clock-generating phase of the operation of the circuitry of FIG. 9, the switches 306 are open and the clear voltage Vc is a logical low value. Each delay cell 302 may delay passing on the input signal until sometime specified by the RC circuit of each delay cell 302. That is, different values of R and/or C may be selected to such that the delay of each delay cell 302 is sized produced for a particular pulse as desired for a particular gray level of the emission clock signal (EM_CLK).

To generate the pulses, the input signal of each delay cell 302 enters a buffer 308, and the output of each delay cell 302 enters an inverter 310. The resulting outputs of these signals are provided as inputs into a NAND logic gate 312. By adjusting the amount of delay associated with each delay cell 302, the pulses output by the NAND logic gate 312 may begin and end at particular points and time (e.g., at t0 and t1, in the case of the first delay cell 302 shown in FIG. 19, or from time t2 to t3, as in the case of the second delay cell 302 shown in FIG. 19). OR logic may operate to combine the pulses from each of the NAND gates 312 to produce the emission clock signal (EM_CLK). When the delay has exited the final delay cell 302 of the delay-locked loop (DLL) of FIG. 19, the signal may be provided to a comparator 318 that may compare the output signal to the reference signal (CLK) 300. When the comparator may output the clear voltage signal Vc to reset the delay cells 302. The delay cells 302 then may reset when the output of the last delay cell 302 exceeds the reference clock (CLK) 300 (e.g., a logic low may propagate through the delay cells 302 thereby resetting the display cells 302 for the next generation of the emission clock signal (EM_CLK).

While the disclosure above describes a number of different examples of circuitry that may be used to generate an emission clock signal (EM_CLK), it should be appreciated that the embodiments discussed above are not intended to be exclusive of one another. Indeed, different types of pulse-generating cells 132 may be used in one emission clock generator 130. Moreover, the capacitors and capacitors reference currents and reference voltages may be adjusted and/or varied as desired to produce pulses that start at any desired time and endure for any desired period. This may allow the emission clock signal (EM_CLK) to generate a substantial variety of pulses that may account for any desired gamma and coding and/or refresh rates. In addition, it should be appreciated that different logic may be used to determine when to start outputting a pulse and when to stop outputting a pulse based on the various pulse-starting signals (e.g., from various of the comparators) and the various pulse-ending signals (e.g., from comparators or delay circuits). Using FIG. 11 by way of example, while an XOR gate is shown in FIG. 11, an XNOR gate may be used instead if the inverse of the signals is provided as inputs to the XNOR gate. Likewise, an AND gate may be used if output of the delay circuit 164 of the example of FIG. 11 were inverted. It should be appreciated that any suitable logic that can serve as pulse-generating logic based on the pulse-starting signals and pulse-ending signals may be used.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a microdriver configured to drive at least one sub-pixel based at least in part on an image data signal and an emission clock signal, wherein the image data signal specifies a gray level for driving the sub-pixel, and wherein the emission clock signal comprises a series of pulses of monotonically increasing pulse widths to enable the microdriver to drive the sub-pixel to emit light for a particular amount of time associated with the gray level; and an emission timing controller configured to generate the emission clock signal, wherein the emission timing controller comprises:

a plurality of pulse-generating cells, each of which is respectively configured to generate one of the series of pulses; and combining logic configured to combine the pulses into a single signal to produce the emission clock signal.

2. The electronic display of claim 1, wherein the series of pulses of the emission clock signal increase nonlinearly.

3. The electronic display of claim 1, wherein a first pulse-generating cell of the plurality of pulse-generating cells is configured to trigger a start of a first pulse of the series of pulses at a first point in time when a ramp voltage that increases over time reaches a first reference voltage.

4. The electronic display of claim 3, wherein the emission timing controller comprises a ramp voltage generator configured to generate the ramp voltage and provide the ramp voltage as a common ramp voltage to at least two of the plurality of pulse-generating cells.

5. The electronic display of claim 3, wherein the first pulse-generating cell comprises a ramp voltage generator specific to the first pulse-generating cell that supplies the ramp voltage to the first pulse-generating cell but not to other pulse-generating cells of the plurality of pulse-generating cells.

6. The electronic display of claim 3, wherein the first pulse-generating cell is configured to trigger an end of the first pulse at second point in time when the ramp voltage reaches a second reference voltage that is greater than the first reference voltage.

7. The electronic display of claim 3, wherein the first pulse-generating cell is configured to trigger an end of the first pulse at second point in time based on a delay circuit used by the first pulse-generating cell.

8. The electronic display of claim 1, wherein the plurality of pulse-generating cells are connected to one another in a delay-locked loop.

9. The electronic display of claim 1, wherein the emission timing controller is configured to generate the emission clock signal based on digital counting circuitry that generates the emission clock signal at least in part by counting edges of a first reference clock.

10. The electronic display of claim 9, wherein the emission timing controller is configured to generate the emission clock signal based on digital counting circuitry that generates the emission clock signal at least in part by counting edges of a first reference clock to generate earlier pulses of the series of pulses of the emission clock signal and by counting edges of a second reference clock to generate later pulses of the series of pulses of the emission clock signal, wherein the first reference clock has a higher frequency than the second reference clock.

11. A method comprising:

generating a first pulse beginning at a first time and ending at a second time in a first pulse-generating cell;

generating a second pulse beginning at a third time and ending at a fourth time in a second pulse-generating cell, wherein the third time occurs after the second time and a first pulse width between the first time and the second time is less than a second pulse width between the third time and the fourth time;

generating a third pulse beginning at a fifth time and ending at a sixth time in a third pulse-generating cell, wherein the fifth time occurs after the fourth time and the second pulse width is less than a third pulse width between the fifth time and the sixth time; and combining at least the first pulse, the second pulse, and the third pulse to generate a clock signal.

12. The method of claim 11, comprising using the clock signal to drive a sub-pixel of an electronic display to emit light for a particular amount of time.

13. An electronic device comprising:

a processor configured to generate image data; and an electronic display configured to receive and display the image data, wherein the electronic display is configured to use the image data to drive a sub-pixel of the electronic display based at least in part on an emission clock signal, wherein the emission clock signal comprises a series of pulses of monotonically increasing pulse widths to enable the sub-pixel to be driven to emit light for a particular amount of time associated with a gray level specified for the sub-pixel in the image data, and wherein the electronic display comprises an emission clock generator that includes a plurality of pulse-generating cells, each of which is respectively configured to generate one of the series of pulses of the emission clock signal.

14. The electronic device of claim 13, wherein the electronic device comprises a fitness band, a watch, a slate electronic device, a handheld electronic device, a mobile phone, a notebook computer, a desktop computer, or any combination thereof.

* * * * *